United States Patent [19]

Neville et al.

[11] Patent Number: 4,877,106

[45] Date of Patent: Oct. 31, 1989

[54] SOUND-ATTENUATING DISCHARGE APPARATUS FOR A PACKAGED TERMINAL AIR CONDITIONER

[75] Inventors: Donald G. Neville, Syracuse; David A. Giordano, East Syracuse; Mark R. Hogan, Manlius, all of N.Y.

[73] Assignee: Carrier Corporation, Syracuse, N.Y.

[21] Appl. No.: 187,688

[22] Filed: Apr. 29, 1988

[51] Int. Cl.[4] ..... E04F 17/04

[52] U.S. Cl. ..... 181/224; 181/229; 181/258; 181/296; 98/DIG. 10

[58] Field of Search ..... 181/211, 212, 224, 229, 181/258, 202, 296; 98/DIG. 10

[56] References Cited

U.S. PATENT DOCUMENTS 2,704,504 3/1955 Wilkoning ..... 181/224 X 4,050,364 9/1977 Maus ..... 181/224 X

*Primary Examiner*—B. R. Fuller

*Attorney, Agent, or Firm*—Robert H. Kelly

[57] ABSTRACT

A noise attenuating assembly for use in conjuction with an air conditioning unit having a sloped discharge opening is disclosed. The assembly includes a front wall and a pair of side walls forming a flow path for the conditioned air which is discharged to the space containing the unit. The assembly has a layer of sound attenuating material attached to the inside surface of the walls so that the assembly deflects and absorbs line-of-sight sound produced by the unit fan, thus reducing the noise level of the unit.

9 Claims, 2 Drawing Sheets

SOUND-ATTENUATING DISCHARGE APPARATUS FOR A PACKAGED TERMINAL AIR CONDITIONER

BACKGROUND OF THE INVENTION

This invention relates generally to a packaged terminal air conditioning unit. More specifically, the present invention relates to an apparatus and method for attenuating the noise generated by the indoor blower of a packaged terminal air conditioner (PTAC).

Air conditioning units which are commonly used for light commercial applications such as hospitals, hotels/motels, apartments, and offices are of the type known as a packaged terminal air conditioner. These packaged terminal air conditioners extend through the wall of the enclosure or room and normally have a condensing section located in communication with the outdoor air for discharging heat energy. An evaporator section is provided in communication with the enclosure air for conditioning said air as it is drawn through the unit. Although air conditioner units are described herein, PTAC units may also be heat pumps or the like.

Generally, a PTAC unit is located low on a wall and has a sloped air discharge opening with a grille to disperse conditioned air throughout the entire room. However, the sloped discharge opening of the unit is a line-of-sight noise path from the fan wheel to the occupant of the space. Sound insulating material can be used in the casing of the PTAC unit, but this does not reduce the noise generated by the fan wheel and propagated through the discharge opening. It is desirable, however, to reduce the effect of this direct line-of-sight noise path. To accomplish this, either a redesign of PTAC units is necessary, or the noise source of the PTAC units must be muffled by a retrofittable silencer.

SUMMARY OF THE INVENTION

It is an object of the present invention to provide an apparatus and method to attenuate the blower noise of a slanted front discharge PTAC unit.

It is another object of the present invention to provide a noise reduction muffler assembly capable of being easily attached to a slanted front discharge PTAC unit.

It is a further object of the present invention to provide a retrofittable PTAC silencer adapted to be attached directly to the slanted front discharge area of the PTAC to deflect and absorb line-of-sight sound.

These and other objects of the present invention are attained by means of a muffler assembly or silencer for a PTAC unit having a slanted front discharge. The silencer has a plurality of vertical walls adapted to coact with the air discharge opening of the PTAC unit to secure the silencer thereto. The interior walls of the silencer are lined with sound absorptive material which reduces sound pressure from 2.0 to 3.5 dB(a). The silencer additionally has a vertical discharge opening flange defining grille support surfaces wherein the louvers of the slanted front discharge, after removal therefrom, are inserted in the horizontal discharge opening to regulate the discharge of air therefrom.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENT

The apparatus as set forth herein will be described in reference to a packaged terminal air conditioning unit. It is to be understood, however, that the muffler for attenuating the noise generated by an evaporator fan has like applicability to other types of air conditioning units including window room air conditioners or heat pumps.

Figure 1:
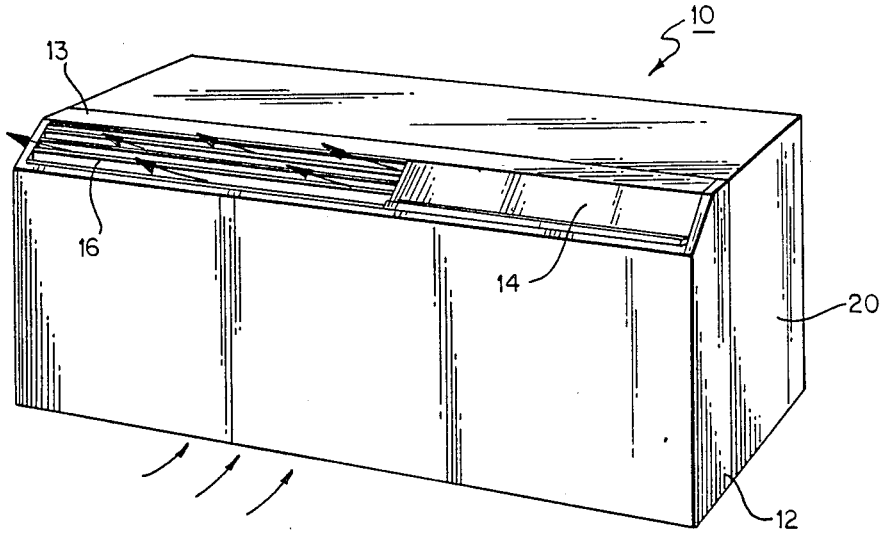
FIG. 1 PRIOR ART
FIG. 1 is an isometric view of a prior art packaged terminal air conditioning unit having a sloped front air discharge.

Referring first to FIG. 1, there may be seen a prior art packaged terminal air conditioning unit 10 having a front cover 12 and a sleeve 20 into which the chassis of the packaged terminal air conditioner unit is installed. The sleeve 20 is typically mounted within a wall of an enclosure such that the front cover 12 is visible to an occupant of the enclosure while the remainder of the unit is supported in the sleeve 20. The sleeve 20 is box-like in shape having a top and bottom and two sides wherein the front is open to slide the packaged terminal air conditioner therein and the back has an outdoor grille therein. The front cover 12 includes a control door 14 covering the control portion thereof, and a discharge grille 16. The discharge grille 16, sloping downward from the top 13 of the front cover 12, directs conditioned air into the space where the unit is located.

Figure 2:
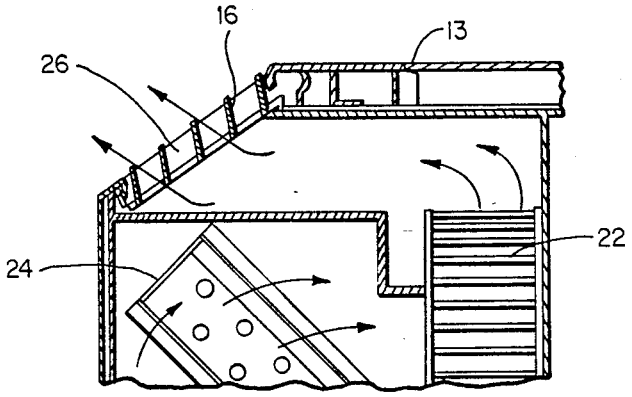
FIG. 2 PRIOR ART
FIG. 2 is a sectional view of a portion of the indoor section of the PTAC unit of FIG. 1.

Referring now to FIG. 2, there may be seen the indoor flow path of the prior art packaged terminal air conditioning unit 10. An evaporator fan 22 draws air upwardly from the bottom of the unit (as shown in FIG. 1) and through the evaporator coil 24. The air then flows through the evaporator fan and is discharged outwardly through the discharge opening 26.

Discharge grill 16 is shown located to cover discharge opening 26 such that there is generally a line-of-sight path for noise created by the evaporator fan 22 to propagate directly into the space to be conditioned. The discharge opening 26 and discharge grille 16 inserted therein are angled from the horizontal plane of the top of the PTAC unit to prevent foreign objects from being placed on the PTAC unit and from falling into the unit.

Figure 3:
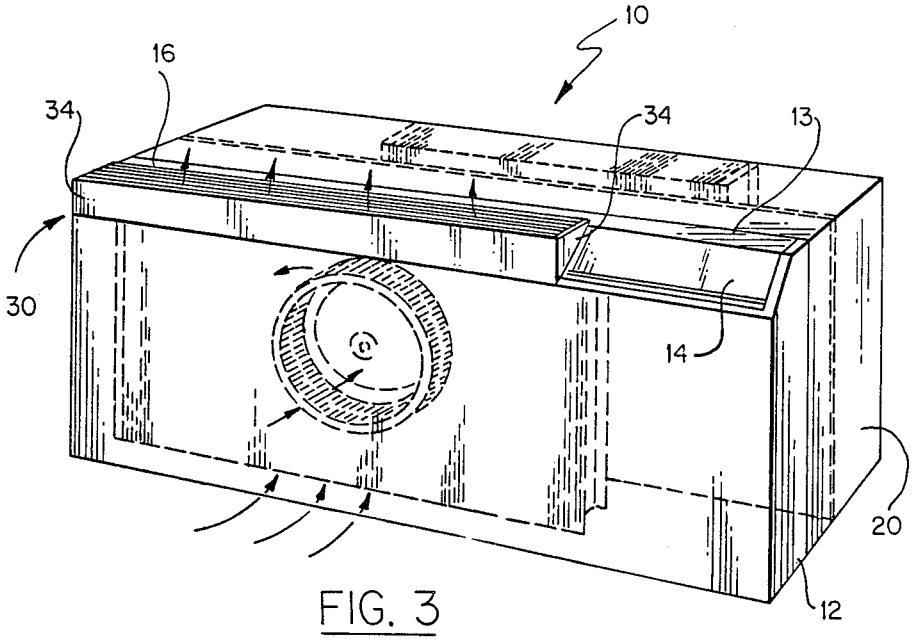
FIG. 3 is an isometric view of a schematic representation of a packaged terminal air conditioning unit showing the air flow through the evaporator and the silencer of the present invention.
Figure 4:
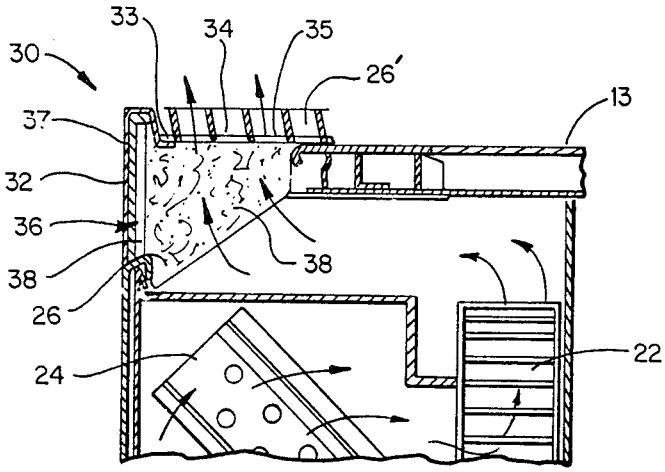
FIG. 4 is a sectional view of a portion of the indoor section of the packaged terminal air conditioning unit of FIG. 3 with the silencer of the present invention.

Silencer 30 of the present invention is shown in FIGS. 3 and 4. Silencer 30 has front wall 32 including front lip 33 and, side walls 34 including side lips 35. The silencer additionally has at least one layer of sound attenuating material 36 (e.g. fiberglass such as black fiberglass by Johns Manville) which is secured to an interior of the front wall 32 and side walls 34 of the silencer 30. It has been found that the sound attenuating material 36 of preferably an inner layer 37 of fiberglass, such as Tuff Skin by Johns Manville, and an outer layer 38 of fiberglass, such as Exacto Board by Johns Manville, in combination with a silencer having walls 32 and 34 generally level with the top 13 of the PTAC deflects and absorbs the largest amount of line-of-sight sound. The outer layer 38 is generally used both for sound attenuating and for preventing erosion of the inner layer 37 by the conditioned air. It has been found that the total thickness of the inner layer 37 and outer layer 38 should be less than or equal to ¾ inch to prevent restricting air flow of the conditioned air through the silencer 30. The height of the walls 32 and 34 of the silencer were found to provide the best esthetics and performance when they generally are in a horizontal plane with the top 13 of the front cover 12.

The silencer 30 is formed to adapt directly to the discharge opening 26 of the front cover 12 of the PTAC unit by removing discharge grille 16 and attaching the silencer 30 to the PTAC 10 e.g. with fasteners. After the silencer 30 is fastened to the front cover 12, the previously removed discharge grille 16 is positioned in discharge opening 26' and held in discharge opening 26' by front lip 30 and side lips 35.

In order to allow a comparison of a PTAC with a muffler of the present invention to unmuffled PTAC's, Table 1 is provided to describe various parameters and performance results.

Table 1 compares the overall sound pressure reduction of a standard PTAC with the PTAC having a muffler of the present invention. Actual test data were collected by locating a microphone at three positions in front of the unit being tested (i.e. 12,000 BTU/hr PTAC's). The microphone was located 1.22M above the floor (approximately level with the top of the PTAC and the top of the muffler) and 1.0M from the front cover of the PTAC. Further, Position 1 was generally even with the left side of the PTAC, Position 2 was generally at the middle of the PTAC, and Position 3 was generally even with the right side of the PTAC as viewed when looking at the front cover of the PTAC. No outdoor fan or compressor was running, and the indoor (evaporator) fan had an air flow rate at 1080 RPM, of 290 CFM for the PTAC without a muffler and 280 CFM for the PTAC with the muffler of the present invention. Ambient or background noise was less than 30 dB(A). The muffled PTAC of the present invention provides far superior overall sound performance as compared to the unmuffled PTAC. For example, with the PTAC in "High Heat," the average sound pressure reduction with the present invention is approximately 2.9 dB(A). This makes a PTAC more enjoyable to an occupant of a conditioned space because annoying noise levels are reduced.

The invention has been described with reference to a particular embodiment, however, it is to be understood by those skilled in the art that variations and modifications can be made within the spirit and scope of the invention.

What is claimed is:

1. In a unit having a fan for moving air to be conditioned through the unit and a discharge opening sloping downward from a top of the unit covered by a removable grille for discharging conditioned air to a space containing the unit, a silencer for attenuating noise generated by the fan comprising:

a vertically projecting assembly adapted to be connected to the sloped discharge opening in place of said grille and defining a flow path for the conditioned air discharged to the space containing the unit, said assembly including a generally vertical front wall and two generally vertical side walls connected to said front wall, said assembly having means attached to at least one said wall for securing said assembly to the unit, and a sound attenuating material layer means adapted to be connected to an inside surface of said walls for absorbing sound.

2. In a unit as set forth in claim 1 wherein said vertically projecting assembly projects vertically to a height generally in a plane with the top of the unit.

3. In a unit as set forth in claim 1 wherein said sound attenuating material layer means is fiberglass.

4. In a unit as set forth in claim 3 wherein said fiberglass layer is generally equal to or less than ¾ inch thick.

5. A sound attenuating assembly for use in an air discharge stream of a sloped front unit for supplying conditioned air to a space, said assembly comprising:

a muffler member having at least a generally vertical front wall and two spaced apart generally vertical side walls forming a vertical flow path for the air discharge stream; and a layer of sound attenuating material adapted to be connected to an inside surface of said walls for absorbing sound, said muffler member adapted to be removably connected to the sloped front of the unit to reduce the noise of the unit transmitted along a direct line-of-sight path.

6. A sound attenuating assembly as set forth in claim 5 wherein said layer of sound attenuating material is fiberglass.

7. A sound attenuating assembly as set forth in claim 6 wherein said fiberglass layer is generally equal to or less than ¾ inch thick.

8. A method of reducing the noise along a line-of-sight path generated by a fan of a unit supplying conditioned air to a space and having a sloped discharge opening covered by a removable grille comprising the steps of:

removing the grille from the sloped discharge opening;

providing a silencer assembly around the sloped discharge opening, the silencer assembly defining a vertical flow path for the conditioned air discharged from the sloped discharge opening and providing a horizontal discharge opening at an outlet end of said silencer assembly; and providing a layer of sound attenuating material around an inner surface of said silencer assembly.

9. The method of reducing the noise as set forth in claim 8 further including the step of reinstalling the removed grille in said horizontal discharge opening.

* * * * *